US012448176B2

(12) United States Patent
Stephens et al.

(10) Patent No.: US 12,448,176 B2
(45) Date of Patent: Oct. 21, 2025

(54) INSULATED CONTAINER FITTING

(71) Applicant: CALIFORNIA INNOVATIONS INC., Toronto (CA)

(72) Inventors: Richard C. Stephens, Chicago, IL (US); Kenneth Macalino, Chicago, IL (US)

(73) Assignee: CALIFORNIA INNOVATIONS INC. (CA)

( * ) Notice: Subject to any disclaimer, the term of this patent is extended or adjusted under 35 U.S.C. 154(b) by 96 days.

(21) Appl. No.: 17/962,121

(22) Filed: Oct. 7, 2022

(65) Prior Publication Data

US 2024/0116677 A1 Apr. 11, 2024

(51) Int. Cl.
*B65D 25/06* (2006.01)
*B65D 81/38* (2006.01)
*F25D 3/06* (2006.01)

(52) U.S. Cl.
CPC ..... *B65D 25/06* (2013.01); *B65D 81/3813* (2013.01); *F25D 3/06* (2013.01)

(58) Field of Classification Search
CPC .... B65D 25/06; B65D 25/04; B65D 81/3813; B65D 81/245; F25D 3/06; F25D 23/069; A45C 2013/028
USPC ..... 222/386; 215/231; 220/564, 578, 720, 220/530, 579, 531
See application file for complete search history.

(56) References Cited

U.S. PATENT DOCUMENTS 3,164,289 A * 1/1965 Cocchiarella ..... B65D 81/245 D7/354
6,817,480 B1 * 11/2004 Baldasio ..... B65D 81/245 220/252
2007/0215624 A1 * 9/2007 Smallwood ..... B65D 81/245 220/578
2018/0120013 A1 * 5/2018 McGarry ..... F25D 3/06

* cited by examiner

*Primary Examiner* — Don M Anderson
*Assistant Examiner* — Elizabeth J Volz
(74) *Attorney, Agent, or Firm* — OSTROLENK FABER LLP

(57) ABSTRACT

A cooler insert partition is provided for a container having a hard-walled internal chamber surface. The partition has a spanning matrix and a peripherally extensive margin that defines a dimensionally variable boundary that follows the tapered chamber wall, functions as a wiper, and is deformable in at least one of (a) in-plane compression; and (b) out-of-plane deflection. The margin forms an edge of the spanning matrix. The partition is insulated, and is softer and more flexible than the hard-walled chamber surface. The periphery is thinner in cross-section than the spanning matrix and has a smaller specific flexural modulus. The partition has articulated panel sections. The partition is made from a single polymeric monolith that has been cut and formed. In use the partition is progressively re-positioned in the chamber to minimize dead air space as container contents are removed.

19 Claims, 7 Drawing Sheets

INSULATED CONTAINER FITTING

FIELD OF THE INVENTION

This invention relates to the field of portable insulated containers.

BACKGROUND OF THE INVENTION

Insulated containers may be used to transport articles that may best be served cool, such as beverages or salads, or warm, such as appetizers, hot dogs, and so on. Such containers are also used to carry liquids, whether hot, such as soup containers, coffee or tea, or cold such as beer, soft drinks, or other carbonated beverages, juices and milk. The containers are typically made in a generally cube-like shape, whether of sides are of equal length or not, having a base, four upstanding walls, and a top. Most often they are generally rectangular in plan view, have a hinged lid attached along one of the long edges, and have lifting handles at either end. The top wall is often a lid which opens to permit articles to be placed in, or retrieved from, the container.

Coolers may be either hard sided or soft sided. Hard sided coolers are typically coolers that have been molded from a rigid material, often by blow molding or rotational molding. Soft-sided coolers have a wall structure that is made of soft fabric walls that have a layer of insulation between inner and outer fabric skin layers. Soft-sided cooler are often provided with rigid internal liners to help them hold liquids and also to help them hold their shape.

Whether a cooler is a soft-sided cooler or a hard sided cooler, it is often desirable for the cooling (or heating) to have an extended endurance. This can, of course, be done by increasing insulation, improving seals, and so on. But another approach to improving the endurance of cooling or warming in the cooler is to slow the rate at which the cooling element, such as ice or an ice-pack of freezing gel, or a warming pack, loses its potential to cool or heat objects.

SUMMARY OF THE INVENTION

As described, there is an insulated partition with a stiff center and a softer periphery. In an aspect of the invention, a partition for an insulated container is dimensionally tolerant to follow the walls of a tapering container as the contents of the container are removed.

In another aspect there is a cooler insert fitting having a spanning matrix and a peripherally extensive margin. The peripherally extensive margin defines a dimensionally variable boundary follower.

In a feature of that aspect, the cooler insert is at least partially insulated. In another feature, the cooler insert is articulated to permit partial opening thereof. In still another feature, insert is softer and more flexible than a rigid cooler liner. In another feature, the insert has a periphery that defines a deflectable wall-following wiper. In an additional feature, the periphery forms an edge of the spanning matrix of the cooler insert, and the periphery is thinner in cross-section than is the spanning matrix. In still another additional feature, the periphery has a smaller specific flexural modulus than the matrix. In another feature, the spanning matrix and the periphery are made from a single monolith of sheet stock. In a further feature, the monolith is a blank that has a molded edge that is thinner than the spanning matrix.

In another feature, the peripherally extensive margin is deformable in at least one of (a) in-plane compression; and (b) out-of-plane deflection.

In another aspect, there is a partition for use inside a cooler, the partition having a spanning portion and a wall-follower portion, the wall follower portion being deflectable.

In a feature of that aspect, the wall follower portion is more easily compressed in in-plane deflection than is the spanning portion. In another feature, the wall follower portion is more easily deflected out-of-plane in bending than is the spanning portion. In a further feature, the wall follower of the partition defines a wiper. In still another feature, the partition is articulated to permit partial opening. In yet another feature, at least part of the spanning portion is insulated. In still another feature, the partition is made from a monolith of a polymeric material. In another feature, the spanning portion has a higher flexural modulus than does the wall follower portion. In yet another feature, the spanning portion is thicker than is the follower portion. In another feature, the partition is made of a monolith of polymeric material. The partition has a set of panels. The panels are joined at articulations defined by hinges. The follower portion is thinner than the matrix portion. The partition is insulated.

In a further aspect, there is a cooler. It has a cooler body and a movable internal partition. The cooler body has one of (a) rigid body that includes a rigid internal liner; (b) a rigid internal liner within a soft-sided body. The rigid internal liner has a tapered upstanding wall. The rigid internal liner has a smaller internal size at bottom than at its mouth. The internal partition has central spanning portion and a peripheral portion. The internal partition is dimensionally tolerant to ride against the tapered internal wall of the internal liner.

In another feature, the container has a lid that mates with the cooler body at a sealed closure. In still another feature, the sealed closure includes a male rim mounted to one of (a) the cooler body; and (b) the lid; and a female channel mounted to the other of (a) the lid and (b) the cooler body, and the rim and the channel mutually engage when the lid is closed. In a further feature, the partition has a spanning portion and a wall-follower portion, the wall follower portion being deflectable. In still another feature, the wall follower portion is at least one of (a) more easily compressed in in-plane deflection than is the spanning portion; and (b) more easily deflected out-of-plane in bending than is the spanning portion. In an additional feature, the partition is articulated to permit partial opening. In another feature, the partition is made from a monolith of a polymeric material and the spanning portion is at least partially insulated. In another feature, the spanning portion is thicker than is the follower portion, and the spanning portion has a higher flexural modulus than does the wall follower portion. In still another feature, the partition is made of a monolith of polymeric material; the partition has a set of panels, the panels being joined at articulations defined by hinges; the follower portion is thinner than the matrix portion; and the partition is insulated.

Another aspect of the invention is the method or use of the insert fitting to minimize dead air volume trapped within the container underneath the insert fitting. Expressed differently, it is to minimize the volume of dead air between the insert fitting and the inside of the cooler.

In another aspect there is a method of using a cooler insert fitting in combination with a cooler. The cooler insert has a spanning matrix and a peripherally extensive margin. The peripherally extensive margin defining a dimensionally variable boundary follower. The method includes placing contents in the cooler; placing a thermal storage element in the cooler; seating the insert fitting within the cooler in a first position; removing a portion of the contents from the cooler; re-positioning the fitting in a second position in the cooler; and in the second position of the insert fitting there being less volume within the container below the insert fitting than in the first position of the insert fitting.

In a feature of that aspect, the method includes at least one of: (a) in the first position of the insert fitting, placing the insert fitting in contact with at least one of (i) the contents; and (ii) the thermal storage member; and (b) in the first position of the insert fitting, placing the insert fitting in contact with at least a portion of a remainder of (i) the contents; and (ii) the thermal storage member. In another feature, after successive removals of contents from the cooler, repeatedly advancing at least a portion of the insert fitting to remain in contact with at least one of the remainders of (i) the contents; and (ii) the thermal storage member. In another feature, the method includes repeatedly re-positioning the insert fitting progressively to reduce volume that is enclosed within the container beneath the insert fitting.

In another feature, the method includes deflecting at least a portion of the peripherally extensive margin in the second position of the insert fitting. In still another feature, in the first position of the insert fitting the peripherally extensive margin engages the container. In the second position of the insert fitting the peripherally extensive margin engages the container. In the second position the peripherally extensive margin is more deflected than in the first position. In a further feature, the method includes progressively re-positioning the insert fitting to reduce volume within the container underneath the insert fitting. As the insert fitting is re-positioned the peripherally extensive margin is increasingly deflected as volume is reduced. In another feature, the method includes minimizing dead air volume trapped within the container underneath the insert fitting.

In another feature, the method includes lifting a hinged portion of the insert fitting to obtain access to the contents of the container. In a further feature, the method includes draining at least one of (a) meltwater; and (b) condensation. In still another feature, the method includes removing the insert fitting from the container, closing the container; placing the insert fitting on top of the container; and sitting on the insert fitting. In yet another feature, the container has a lid, and the method includes closing the lid after positioning the insert fitting. In another feature the method includes minimizing dead air volume trapped within the container underneath the insert fitting. In a yet further feature, the method includes folding the insert fitting back on itself to a folded storage position when not in use.

BRIEF DESCRIPTION OF THE DRAWINGS

These aspects and other features of the invention may be understood with the aid of the following illustrations of exemplary, and non-limiting, embodiments of the principles of the invention in which.

DETAILED DESCRIPTION

Figure 1A:
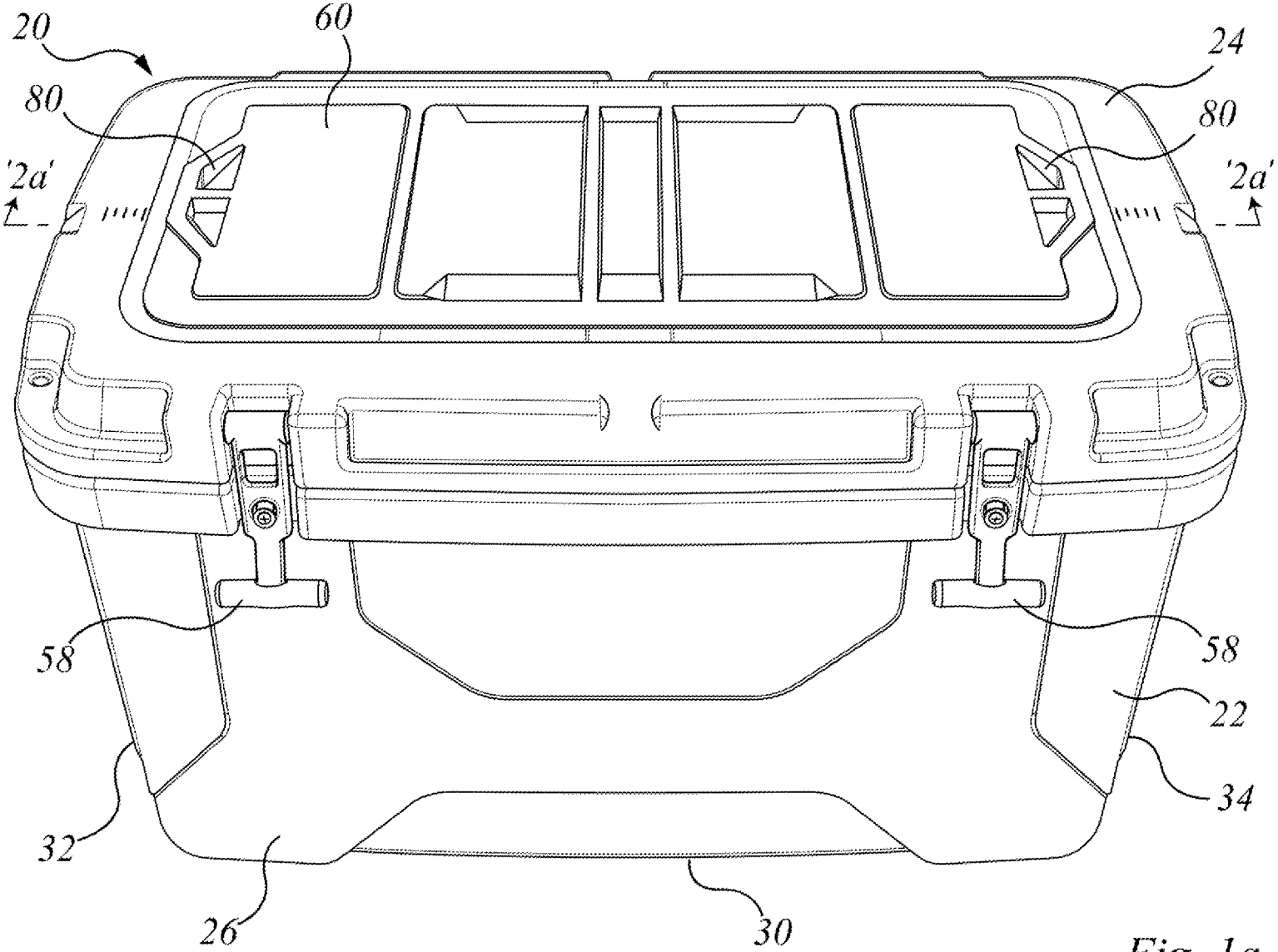
FIG. 1*a* shows a perspective view of a hard-sided insulated container with its lid closed.

The description that follows, and the embodiments described therein, are provided to illustrate examples of particular embodiments of the principles of the present invention. These examples are provided for the purposes of explanation, and not of limitation, of those principles and of the invention. In the description, like parts are marked throughout the specification and the drawings with the same respective reference numerals. The drawings are substantially to scale, except where noted otherwise, such as in those instances in which proportions may have been exaggerated in order more clearly to depict certain features of the invention.

This description may employ a Cartesian frame of reference. The vertical direction, or z-axis, extends in an up and down orientation from bottom to top. The x-axis extends in the shorter dimension of the container assembly running in the front-to-back direction. The y-axis extends cross-wise horizontally relative to the x-axis, running in the side-to-side direction. Unless noted otherwise, the terms "inside" and "outside", "inwardly" and "outwardly", refer to location or orientation relative to the associated enclosed space of the container assembly, as may be. The base of the article, where substantially planar, may be considered to extend in an x-y plane. The height of the article may be measured in the vertical, or z-direction. In other contexts, when looking at a single panel, reference may also be made to the "through-thickness" direction or dimension through the wall structure. The common engineering terms "proud", "shy" and "flush" may be use in this description in relation to parts of components that protrude, that are recessed, or that stand in line with neighbouring items, the three terms being conceptually similar to the conditions of "greater than", "less than" and "equal to" respectively.

The largest container panels herein may be designated arbitrarily as either the front and rear sides, walls, faces, or portions of the container. Similarly, the closure member, or opening is arbitrarily designated as being at the top, and the base panel is designated as being at the bottom, as these terms may be appropriate for the customary orientation in which the objects may usually be found, sold, or employed, notwithstanding that the objects may be picked up and placed on one side or another from time to time at the user's choice. It should also be understood that, within the normal range of temperatures to which food and touch is accustomed, although the term cooler, or cooler container, or cooler bag, may be used, such insulated structures may generally also be used to aid in keeping food, beverages, or other objects either warm or hot as well as cool, cold, or frozen. That is, although the term "cooler" may be used for convenience in describing a thermally insulted container, the "cooler" may sometimes be used to keep objects warm rather than cold, e.g., as when hot foods are being transported from a kitchen, or take-out restaurant, to a place where those foods will be eaten some distance away.

The term "insulated" or "insulated wall structure" may be used in this description. It is intended to pertain to walls having a layer of thermal insulation. Typically such walls have an inner surface or lining or web, an outer surface or lining or web, and a layer of insulation material captured between the inner and outer surfaces. The outside layer may be a wear-resistant or scuff resistant material. Thin single membranes or sheets of web material, such as woven high-density Nylon™, or Vinyl™, or leather, or paper, are not of themselves intended to fall within the meaning of the term "insulated" as used herein unless they have been treated or formed in a manner deliberately to enhance thermal insulating properties.

Accordingly, the adjective "insulated" is intended to be given its usual and normal meaning as understood by persons skilled in the art. It is not intended to encompass single layers, or skins, of conventional webbing materials, such as Nylon™, woven polyester, canvas, cotton, burlap, leather, paper and so on, that are not otherwise indicated as having, or being relied upon to have, particular properties as effective thermal insulators other than in the context of being provided with heat transfer resistant materials or features beyond that of the ordinary sheet materials in and of themselves. Following from *Phillips v. AWH Corp.*, this definition provided herein is intended to supplant any dictionary definition, and to prevent interpretation in the US Patent Office (or any other Patent Office) that strays from the customary and ordinary meaning of the term "insulated". The Applicant also explicitly excludes cellophane, waxed paper, tin foil, paper, or other single use disposable (i.e., not intended to be re-used) materials from the definition of "washable".

A soft-sided insulated structure is one in which the insulated panels are flexible panels, typically in the form of fabric or plastic sheets with insulation inside. The insulation usually has the form of a flexible open cell or closed cell billet, or slab, which may have been bent or folded or molded into the shape of the wall structure.

A soft-sided insulated structure may be understood as being in contrast to a hard-sided insulated structure in which the insulation is contained within a rigid molded structure, and in which the insulation itself may be substantially rigid. In that regard, too, this description distinguishes of hard-shell containers from soft-sided containers. In the jargon of the trade, a soft-sided cooler, or bag, or container, is one that does not have a substantially rigid, high density exoskeleton. A typical example of a container having a hard exoskeleton is one having a molded shell, e.g., of ABS or polyethylene, or other common types of molded plastic. Rather, a soft-sided container may tend not to be substantially rigid, but may rather have a skin that is flexible, or crushable, or sometimes foldable. By way of an example, which is not intended to be exhaustive, comprehensive, exclusive or limiting, a soft-sided cooler may have an outer skin, a layer of insulation, and an internal skin, both the internal and external skins being of some kind of webbing, be it a woven fabric, a nylon sheet, or some other membrane. The layer of insulation, which may be a sandwich of various components, is typically a flexible or resilient layer, perhaps of a relatively soft and flexible foam.

In some instances, a substantially rigid liner is mounted inside the soft-sided insulated structure to stiffen it. The liner is typically removable. In some examples, a soft-sided insulated wall structure may include one or more permanent or removable battens or stiffeners (which may be of a relatively hard plastic) concealed within the soft-sided wall structure more generally. Soft-sided insulated containers may have hard molded fittings either at a container rim or lip, or to provide a base or a mounting point for wheels, where the outside of the assembly nonetheless remains predominantly of soft-sided panels. Once again, this commentary is intended to forestall the adoption by the US Patent Office, (or any other Patent Office), of an interpretation of the term "soft-sided" that diverges from the ordinary and customary meaning of the term as understood by persons of ordinary skill in the art in the industry, and as used herein.

Figure 1B:
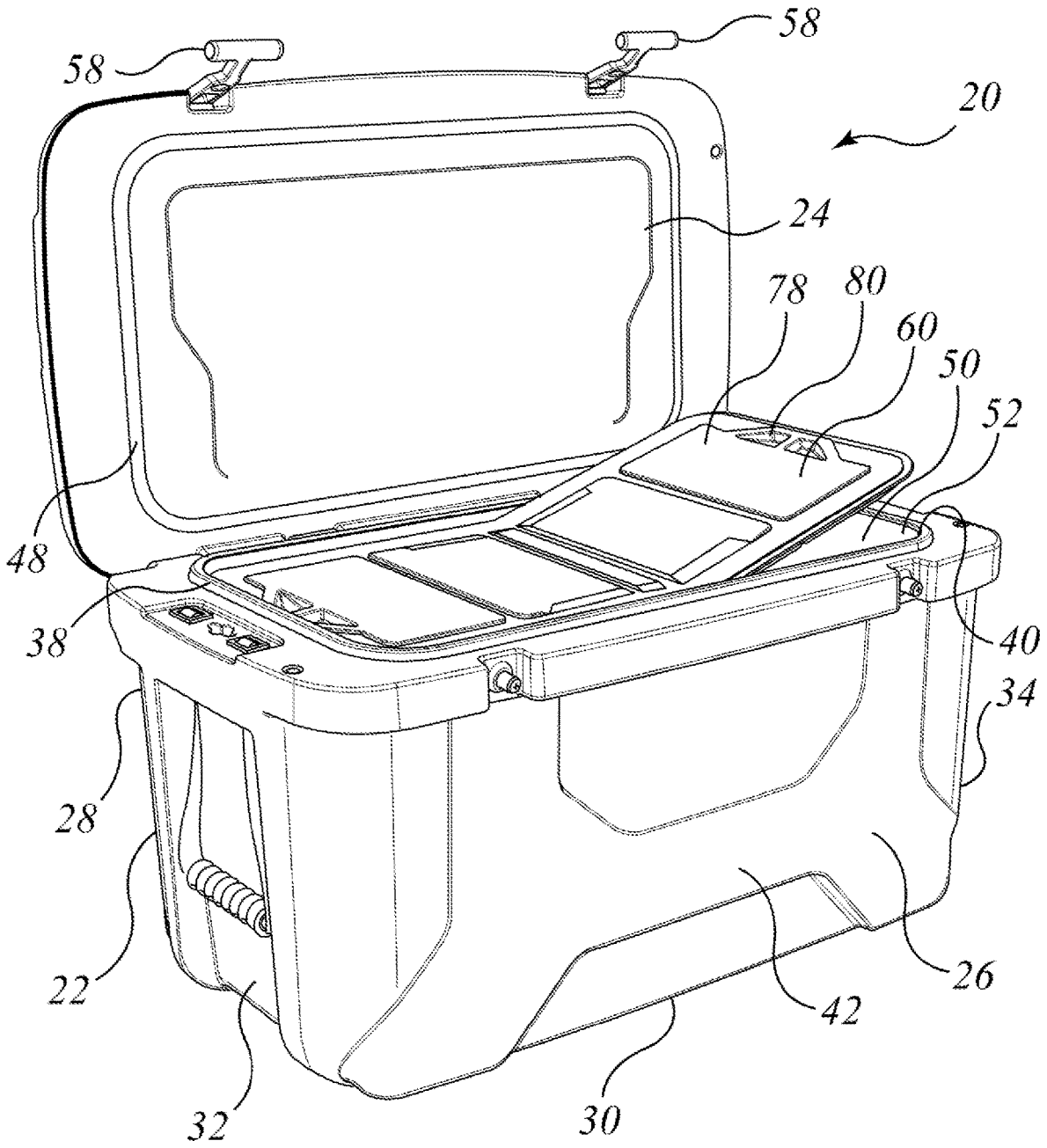
FIG. 1*b* shows a perspective view of the hard-sided insulated container of FIG. 1*a* with the lid open showing an insert fitting at a full container position and with an access panel portion of the insert fitting in a partially open position.

As a general overview, FIGS. 1*a* and 1*b* show a hard-sided insulated container assembly identified as 20. Although it can be used to keep objects either warm or cold, in the example insulated container assembly 20 may be referred to as a "cooler". Container assembly includes a first portion such as may be identified as a first body portion 22 which may be, and in the example of FIG. 1*a* is, a hard-sided, insulated wall structure which is first or main portion, or main body of container assembly 20. Container assembly 20 also includes a second portion 24. Second portion 24 may be, and in the example illustrated is, a lid or lid assembly that is hingedly mounted to the upper rearward margin of the first body portion, namely main body 22. Lid assembly 24 is movable in a first degree of freedom between a first position, such as a closed position as shown in FIG. 1*a*, and a second position such as an open position as shown in FIG. 1*b*. In the example illustrated lid assembly 24 is hingedly mounted to body 22, and the first degree of freedom is a rotational degree of freedom, namely pivotal motion about a hinge axis, between the first and second positions.

First body portion 22 may have, and as illustrated has, the form of an open-topped five-sided box having a front wall 26, a rear wall 28, a bottom wall 30, a first end wall 32 and a second end wall 34. Front wall 26 and rear wall 28 are spaced apart and opposed. First end wall 32 and second end wall 34 are similarly spaced apart and opposed. Walls 26, 28, 32 and 34 are arranged about the margins of bottom wall 30 and form an upstanding peripheral sidewall 36 standing upwardly from bottom wall 30. The upper margins of walls 26, 28, 32 and 34 co-operate to define a rim, or land, or accommodation, or seat 38 that mates with a co-operating peripheral rim, land, accommodation extending around the margins of lid 24. In the example shown, the rim is molded to stand upwardly from the body or base, and lid 24 has a molded channel 48 formed therein. Rim 38 of body portion 22, seats in channel 48 of lid 24. Channel 48 may also have a gasket 54 against which rim 38 stops. The relationship of the closure defined by the co-operation of rim 38 and channel 48 (and seal 54 if present), is of a sealed closure. Lid 24 is held closed by, and gasket 54 is energized by, the securement of latches 58.

Each of the various wall panel portions of the upstanding sidewalls has an external hard-shell skin 42, an internal hard-shell skin 44 and a layer of insulation 46 captured between outer and inner skins 42 and 44. In the example shown body portion 22 and lid 24 may each be a plastic molding. While they could be made by blow molding, or by assembling injection molded parts, in the example illustrated body portions 22 and 24 are rotationally molded parts. Inner skins 44 of walls 26, 28, 30, 32 and 34 form the front, rear, bottom, first end and second end of a continuous wall or membrane that defines an internal lining wall of first body portion 22 that form the boundary walls of an internal chamber 50. Other than a feature such as a water drain 90, such as may have a spigot that is operable to open and close drain 90, the internal wall is water-tight, and suitable for containing liquids. As may be noted, the corners between the various walls are radiused or chamfered, as at 40.

In general, insulated container assembly 20 may have, and in the example does have, the general form of a six-sided box, in which the top of the box is the lid that opens and closes to govern access to the interior of assembly 20, namely to the inside of chamber 50. The six-sided box may be considered as a structure having six rectangular sides. Although the sides may be referred to as being rectangular, and they may closely approximate being rectangular, they need not necessarily be, and, in the general case they are not precisely rectangular.

That is, to the extent first body portion 22 is a molding, its sides may typically have draft angles to permit the body to be released from the mold. Given the existence of the draft angles, chamber 50 has a mouth 52 that has a larger periphery, including a larger width and larger length, than the inside of chamber 50, with the periphery getting smaller progressively toward bottom wall 30. I.e., chamber 50 is tapered to a narrower base, or, expressed conversely, the walls of chamber 50 splayed outwardly from bottom wall 30 toward the mouth 52.

Figure 3A:
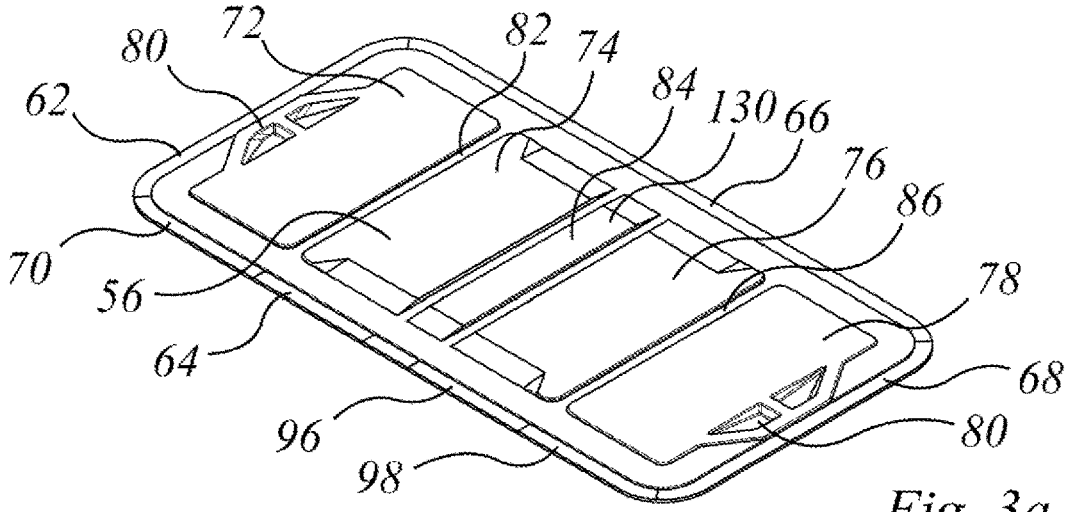
FIG. 3*a* is an isometric view of the insert fitting of FIG. 2*a;*
Figure 3B:
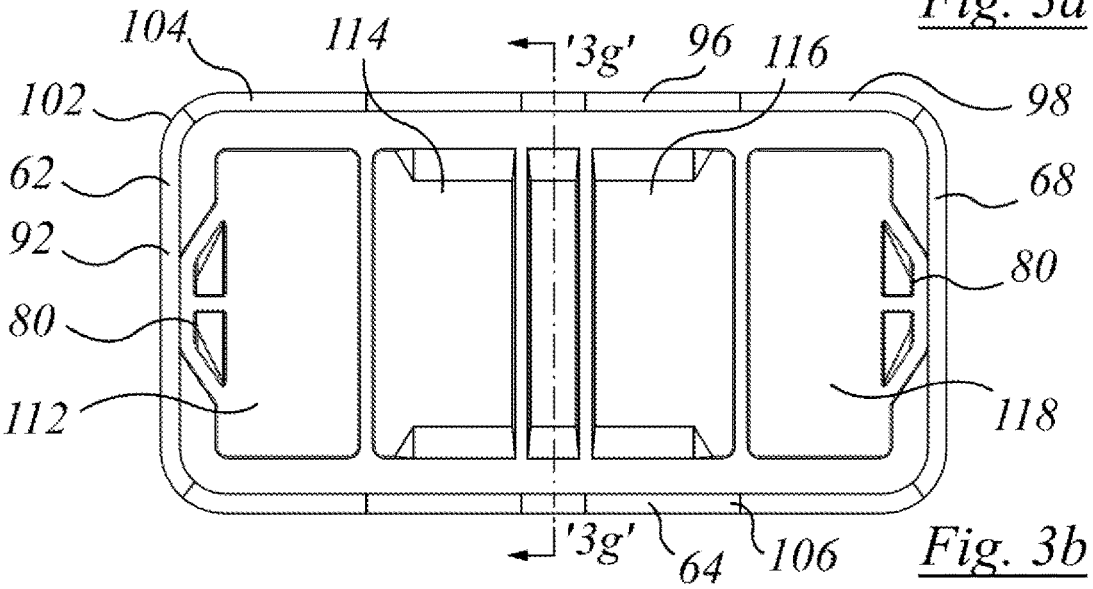
FIG. 3*b* is a top plan view of the insert fitting of FIG. 3*a;*
Figure 3C:
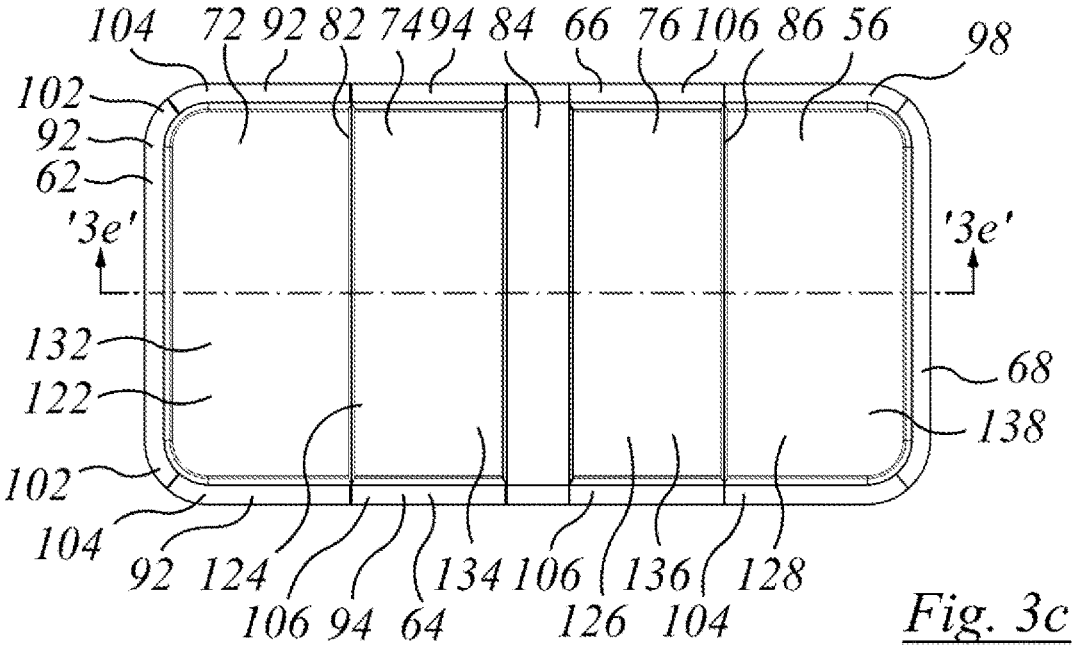
FIG. 3*c* is a bottom view of the insert fitting of FIG. 3*a;*
Figure 3D:
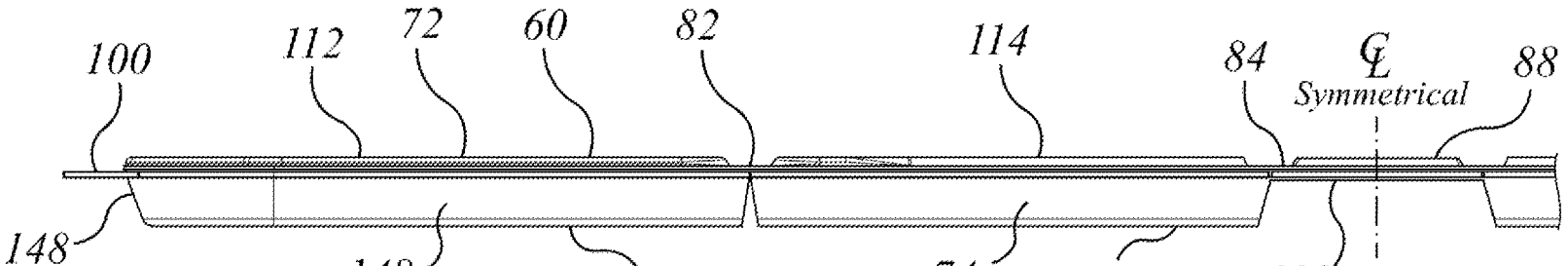
FIG. 3*d* is a side view of half of the insert of FIG. 3*b;*
Figure 3E:
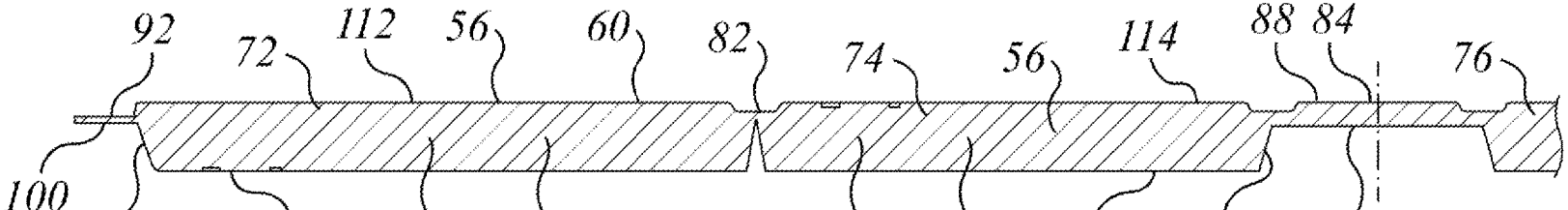
FIG. 3*e* is a side view of half of the insert of FIG. 3*c* taken on '3*e*-3*e'*.
Figure 3F:
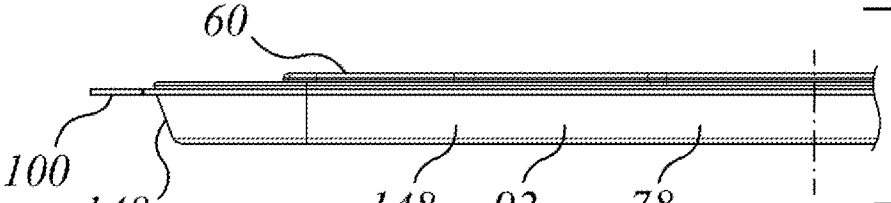
FIG. 3*f* is an end view of half of the insert of FIG. 3*b;*
Figure 3G:
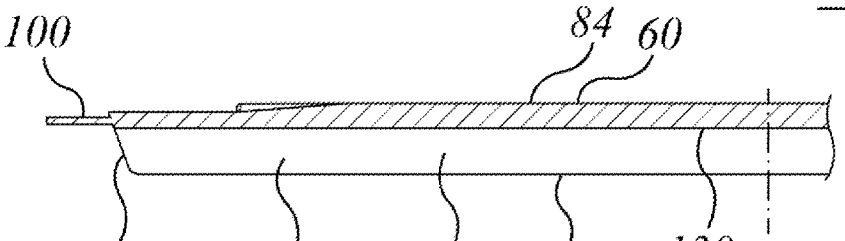
FIG. 3*g* is an end view of half of the insert of FIG. 3*b* taken on '3*g*-3*g'*.

Container assembly 20 has an insert fitting 60. Insert fitting 60 may also be referred to as partition 60. Although it need not be so in the general case, for simplicity in the example given insert fitting 60 as shown is symmetrical about both its long axis (in the x-direction) and its transverse axis (in the y-direction). Accordingly, the long side view of FIG. 3*d* and the short side view of FIG. 3*f* are provided only as half views, given that they are symmetrical about the indicated center lines. Likewise the sectional views of FIGS. 3*e* and 3*g* are half views, given the axis of symmetry. Insert fitting 60 can be termed a membrane, or partition, or barrier, or wall, or segregator. It has a periphery that has a footprint in plan form that has the same shape as the internal periphery of chamber 50. Fitting 60 has a spanning portion, or main portion 56, generally, and has four peripheral marginal edges 62, 64, 66, and 68 that, as installed, are opposed respectively to, and engage, the internal skin 44 of walls 26, 28, 32 and 34.

Insert fitting may be substantially planar and may have, and as shown has, a set of first, second, third, and fourth sections 72, 74, 76 and 78 divided by, or joined by, respective connections, or articulations, in the form of first, second and third hinges 82, 84, and 86. First hinge 82 is between, and joins, first and second sections 72 and 74. Second hinge 84 is between, and joins, second and third sections 74, 76. Third hinge 86 is between, and joins, third and fourth sections 76 and 78. Hinges 82, 84 and 86 make it possible to fold fitting 60 in several different configurations. It may be noted that hinge 84 is wider than hinge 82 or hinge 86, in effect being a slim panel with a back 88 that provides a greater folding reach. That is, when hinges 82 and 86 are folded back on themselves as in FIG. 4*c*, the inside bend radius is small, and can be approximated as zero, or not much more than the thickness of the hinge material itself to permit outside faces 112 and 114 of sections 72 and 74, respectively, to lie against each other. Similarly, outside faces 116 and 118 of sections 76 and 78, respectively, can lie against each other. By contrast, since hinge 84 is bent in the opposite direction it has a longer reach to accommodate the through-thicknesses of adjacent sections 74 and 76 indicated as $t_{74}$ and $t_{76}$, so that, in addition to being able to bend, it also has a reach at least as great as the sum of those thicknesses to permit inside faces 124 and 126 of sections 74 and 76 to be opposed when insert fitting 60 is folded. Although sections 72, 74, 76 and 78 need not all be of the same through thickness, it is convenient that they be of the same thickness such that $t_{74}$ is the same as $t_{76}$. In the fully folded position insert fitting 60 can lie on either inside face 122 or inside face 128 on a flat surface, or may seat on the shoulder defined by margin 62 or 68 on, for example, rim 38.

Figure 4C:
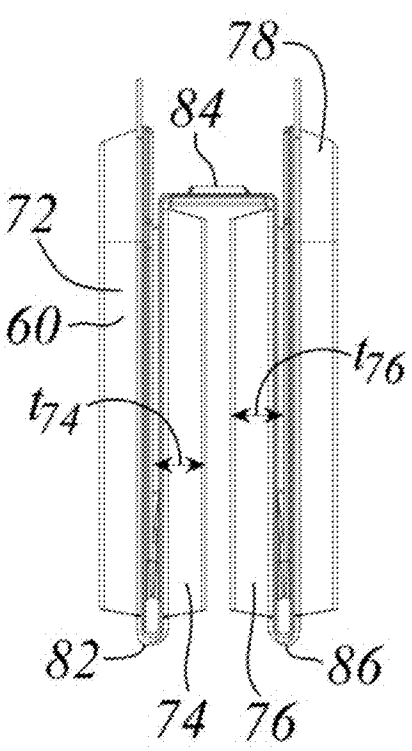
FIG. 4*c* is an end view of the folded insert fitting of FIG. 4*a;*

They may be fully folded when not in use to form a folded set that is only one section wide and as seen in FIG. 4*c*. Alternatively, they may only cover two or three sections, or they may lie flat as a four-section plate or cover, and one or the other of the end sections (i.e., sections 72 and 78) may be lifted individually, as in FIGS. 1*b*, 4*d* and 4*e*, to permit access to the region of chamber 50 that is below fitting 60. To that end, each of the end sections may have, and in the example illustrated does have, a lifting fitting, or a grip 80, that can be pulled up to move the respective section to an open position. Although fitting 60 is shown as being symmetrical in its arrangement of sections, this need not be so. It is convenient that it be symmetrical. One or all of sections 72, 74, 76 and 78 may have a grip such as may be engaged by the user's fingers to lift a portion or all of insert fitting 60. In the example shown end sections 72 and 78 have grips 80. The ability to lift only a portion of insert fitting 60 may tend to allow access to the contents of chamber 50 while reducing the ice melting process of the cooling medium.

As may also be noted, there is a central portion or spanning portion, or main web or matrix 144 of fitting 60, or of its respective sections 72, 74, 76, and 78, however many there may be. The edges or margins of insert fitting 60, or of its respective sections are indicated as 92, 98 (of ends sections 72, 78, respectively), and 94, 96 (of sections 74, 76, respectively). The margins 92, 98 of end sections 72 and 78 are generally U-shaped in plan view, and include all of marginal edges 62, 68 along the respective ends of insert fitting 60 plus the chamfered or radius corners 102 of end sections 72, 78, plus the stub short section edges 104 on either end of sections that are part of marginal edges 64 and 66 respectively. By contrast, margins 94 and 96 of the intermediate section, namely sections 74 and 76 include stub section edges sections 106 of intermediate sections 74, 76, those stub sections 106 being part of marginal edges 64, 66. That is, end sections 72, 78 have margins that extend around three sides, whereas intermediate sections 74, 76 have margins only on their opposite ends.

Figure 2A:
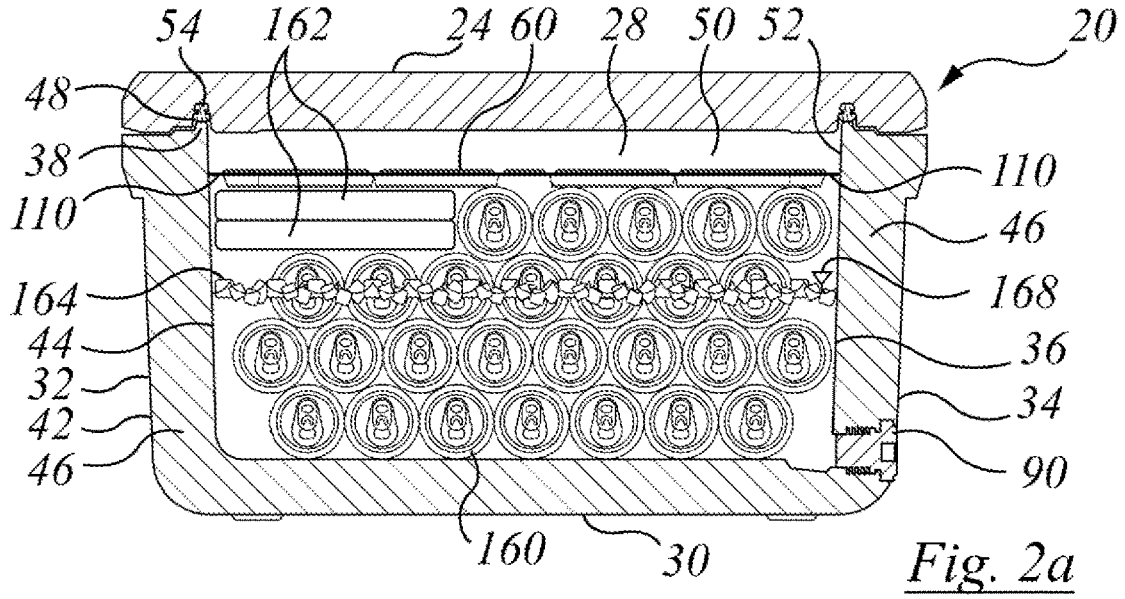
FIG. 2*a* shows a cross-section of the hard sided insulated container of FIG. 1*a* on the longitudinal central vertical plane on section '2*a*-2*a*' of FIG. 1*a* with the insert fitting in a first position.
Figure 2B:
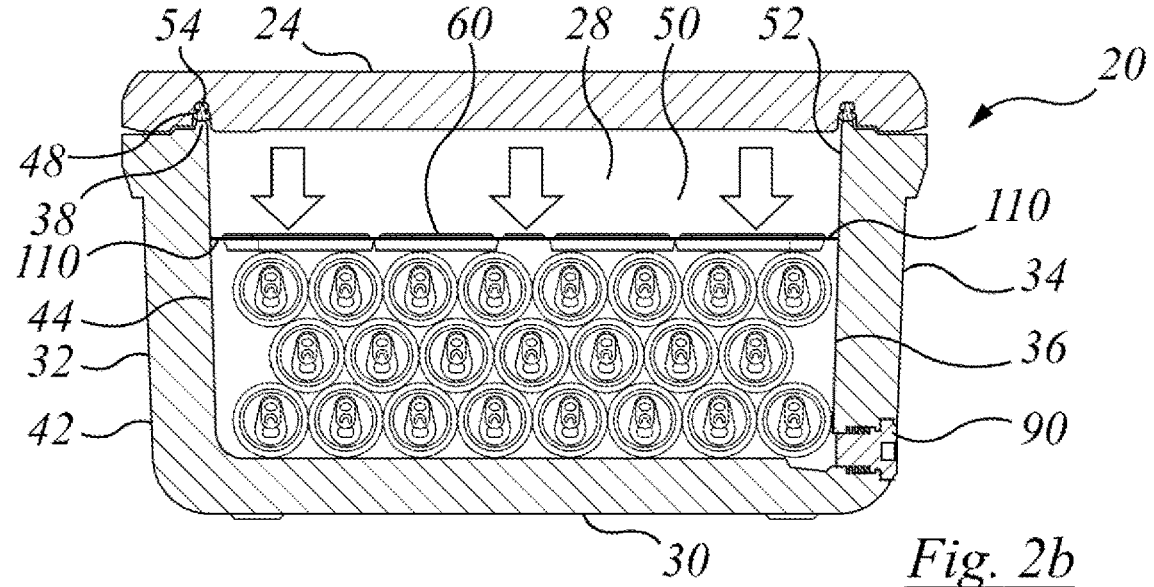
FIG. 2*b* shows the cross-section of FIG. 2*a* with the insert fitting at a second position, the second position being a lower position than the first position and corresponding to a less full condition of the insulate container of FIG. 2*a;*
Figure 2C:
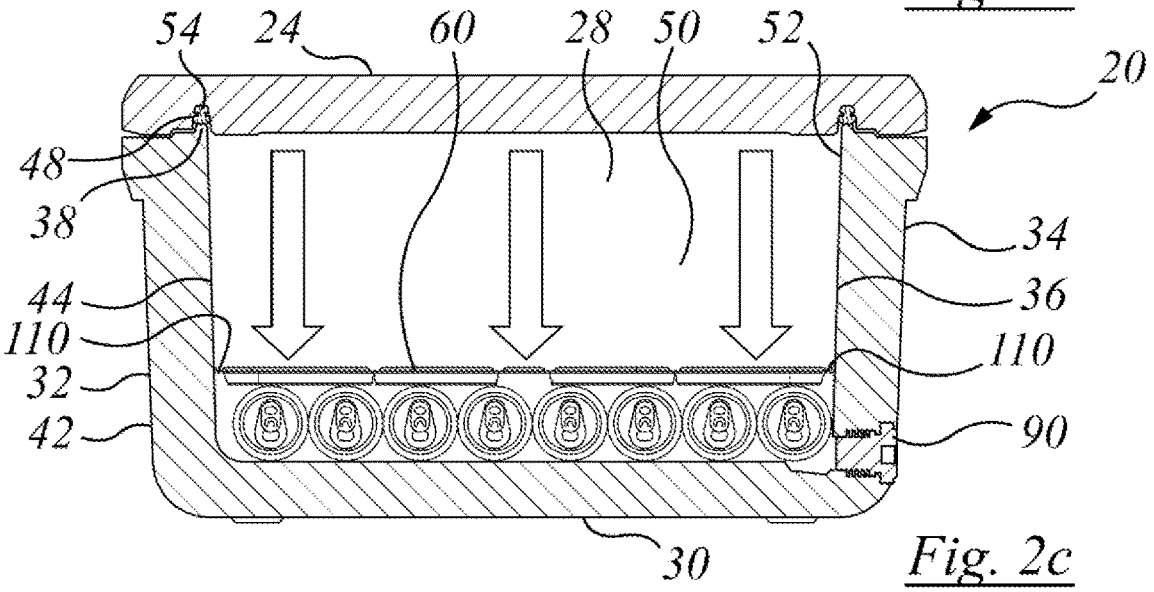
FIG. 2*c* shows the cross-section of FIG. 2*a* with the insert fitting at a third position, the third position being a lower position than the second position, and corresponding to a less full condition of the insulated container of FIG. 2*b;*
Figure 3H:
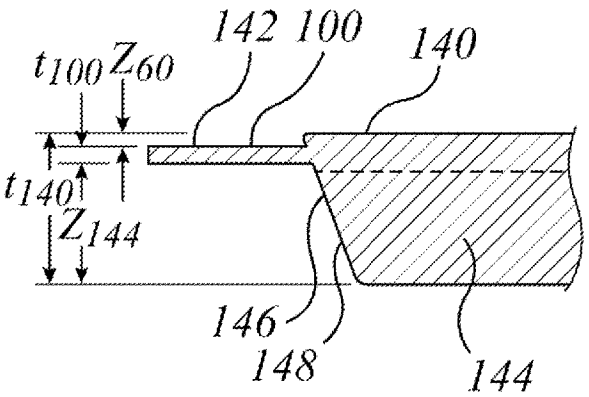
FIG. 3*h* is an enlarged section of the tip of the edge of the sections of either FIG. 3*e* or FIG. 3*g;*

As seen in the example of the partial cross-section of FIG. 3*h*, the respective edge portions or margins 92, 94, 96, 98 have a different stiffness property from the respective main portions or spanning portions 56. Section 72 has a spanning portion 132 that lies between stub section edge 104 on either end, and marginal edge 62 runs along the outboard long side of spanning portion 132 opposite hinge 82 which runs along the inboard long side of spanning portion 132. Section 74 has a spanning portion 134 that has short stub section edges 106 at both short ends, and has hinges 82 and 84 running along its long sides. Section 76 has a spanning portion 136 that has short stub section edges 106 at both short ends, and has hinges 84 and 86 running along its long sides. Section 78 has a spanning portion 138 that lies between short stub section edges 104 at either end, and marginal edge 68 runs along the outboard long edge of spanning portion 138 opposite hinge 86. Edge portions 92, 94, 96, 98 are more compliant than the central spanning web portions 56. That is, the edge portions 92, 94, 96, 98 may tend to deflect more easily than the central spanning portions 132, 134, 136 and 138, respectively, such that the respective edge portions can function as, and be considered to be, wipers 110, or followers, that ride along the inside surface of inside skin 44 of the various wall portions that form the periphery of chamber 50, as illustrated in FIGS. 2*a*, 2*b* and 2*c*.

In FIG. 2*a* chamber 50 is full, the contents being depicted as drink cans 160. The premise is that the contents of chamber 50 are to be cool. To that end, chamber 50 may have a thermal storage member or thermal storage medium. For illustration both gel packs 162 and ice 164 are shown, although it might be expected to have one or the other, rather than both. Where ice is used, melt water 168 may collect in chamber 50, and that there will be a water level in the tub. Although not shown, it may be understood that the level of ice and water in FIGS. 2*b* and 2*c* is successively lower. The liquid water may be drained off by drain 90, or may be left as a bath for beverages, for example. Even when the thermal storage member is contained as in a gel pack, condensation may accumulate. In whichever circumstance, the placement of the partition defined by insert fitting 60 to overlie the contents of chamber 50, and the provision of a peripheral wiper array to discourage air exchange, to discourage air movement underneath insert fitting 60, and to reduce the volume of air between the contents and insert fitting 60.

In the position shown in FIG. 2*a*, the periphery fitting 60 defined by the cooperation of the various respective sections of wipers 110 engage the inside surface of the container wall of chamber 50 in an interference fit. As the contents of chamber 50 are removed (and consumed), fitting 60 may be pushed further into chamber 50, as shown successively in FIGS. 2*b* and 2*c*. As the contents are removed, the ice may melt, and meltwater, or such other liquids as may have collected in chamber 50, may be let out by opening drain 90. By advancing the partition, i.e., insert fitting 60, to ride downward along the converging tapered inside wall 44, as shown in FIGS. 2*b* and 2*c*, the volume of air over the contents is reduced relative to what it would be in the entire chamber 50 up to lid assembly 24 without insert fitting 60. The circulating air trapped beneath insert fitting 60 and above the contents is termed "dead air". By reducing the amount of circulating air, i.e. "dead air", the ice may tend to last longer. That is, the cooling potential of the thermal storage medium, be it a chemical ice pack or ice, tends to be prolonged. In brief, the use of insert fitting 60 tends to extend the life of ice, or ice packs, by eliminating or reducing the volume of dead air in the cooler that might otherwise tend to accelerate the ice melting process.

As insert fitting 60 follows wall 44, and since it is dimensionally tolerant due to its ability to deflect, the compliant margins 92, 94, 96 and 98 deflect so the spanned dimension decreases. In this way, margins 92, 94, 96 and 98 of the first, second, third and fourth marginal edges 72, 74, 76 and 78, and more generally peripheral marginal edge 70 in its totality, follow the wall taper of internal hard-shell skin 44 and so define a dimensionally variable boundary follower of the peripherally extensive margin. The deflection may be out-of-plane bending deflection, in the manner of a deflecting vane, or the deflections may be in-plane compression in the lengthwise or widthwise direction, or some combination of in-plane compression and out-of-plane deflection, as may be. Whether by one mode or the other, or both, as the wipers 110 deflect, they remain in contact with the inside wall in their interference fit. Moreover, when insert fitting 60 is employed, the upper surface of insert fitting 60 provides a surface or shelf upon which other contents may be placed.

Furthermore, the dimensional tolerance of the flexible margins of insert fitting 60 means that insert fitting 60 is not necessarily mated exclusively to one particular type or brand or embodiment of container 20. That is, insert fitting 60 may be used with more than one type or brand of container, but may be suited to function as a common or universal fitting for more than one container type for a particular size, such as a 45 qt. or 55 qt. cooler, and so on, and an insert may fit more than one size of cooler. For example, one insert fitting 60 may be used for a 45 qt cooler, and yet also for a 40 qt cooler that is of sufficiently similar size. Moreover, when insert fitting 60 is employed, the upper surface of insert fitting 60 provides a surface or shelf upon which other contents may be placed. There may be different sizes, such as a first size to fit coolers in a first range, such as 25 qt to 40 qt; a second size to fit coolers in a second range, such as 45 qt to 65 qt; a third size to fit coolers in a third range such as 70 qt to 90 qt; and a fourth size, such as 95 qt to 110 qt. For the purposes of this description, 1 US Quart is approximately the same as 1 Liter in the Metric system, so those sizes could be restated as 25 to 40 L; 45 to 65 L, 70 L to 90 L and 95 L to 110 L. The length of the flexible finger, or margin, may be about 1 inch (2.5 cm). Since the margins run along both sides, the total margin is about 2 inches, giving a range of flexibility of about 1¾". The more rigid span length may be 5 to 15 times as great as the combined double-margin width, and in some embodiments the sum of the finger lengths of the margins on both edges extending outward from the stiffer spanning portion is ⅛ to 1/12 of the overall span distance in the front to back direction of the cooler.

Insert fitting 60 may be, and in the embodiment illustrated is, a relatively soft foam panel. It has a springy rigidity of a firm or stiff quilt or stiff spongy foam mat. It has a softer texture (like a sheet of cork, or silicone rubber) than the molded hard-shell walls of the cooler, or, in particular, of internal hard-shell skin 44, which may be a rigid polypropylene or ABS, or the corresponding hard-shell skin of an insert tub of a soft-sided cooler. In the embodiment shown, matrix 56 of insert fitting 60 is sufficiently stiff that insert fitting 60 will hold its own shape and support its own weight in a generally planar manner; but it is sufficiently flexible that it can deform or deflect to follow the walls and unevenness in the contents in the chamber below to some extent, in a similar manner to a cork or foam rubber sheet.

As indicated, the edge portions 92, 94, 96, 98 of insert fitting 60 are more compliant than the central portion 56. Insert fitting 60 may be made of a monolith, i.e., made of a single piece of feed-stock, or raw material. Insert fitting 60 can be made as a casting or injection molding. In the example shown, insert fitting 60 is made from a sheet of feedstock cut to shape to the plan-view profile of FIG. 3*b*, and then further processed to form margins 92, 94, 96, 98 of reduced thickness, as in thinned finger 100 in FIG. 3*h*. The concept of easier compliance may be expressed in different ways. One way is to compare the sectional flexural modulus of finger 100 one unit wide with the sectional modulus for a similar one unit wide strip in the midst of the spanning portion 56 of the matrix, as at 144. The flexural modulus, EI, is the product of the moment of inertia of the section, I, and the Young's modulus of the material, E. Assuming the Young's modulus of the material to be the same, the moment of inertia is $I=(bh^3/12)$, so the proportionate difference in compliance in bending will vary as the difference of the cubes of the respective sectional heights (i.e., vertical through-thicknesses). In terms of in-plane compression normal to the locus of contact of the respective peripheral margin 70 taken in its totality, or its marginal components, being margins 92, 94, 96, and 98 individually with the inside container wall 44 can be roughly approximated as being a function of the cross-sectional area in linear compression as a spring (i.e., compression in the plane of insert fitting 60, generally). The thickness of the cross-section of the reduced-thickness finger 100 is thinner than the body of main portion 56 of insert fitting 60, and so therefore it is softer in lineal compression. Additionally, in terms of out of plane bending deflection (i.e., in the z-direction) such that there is a corresponding reduction in in-plane span because the end of fingers 100 are deflected or curved or bent back. This out-of-plane deflection is proportional to the flexural modulus.

In coolers, ice pack or ice cube duration tends to be a function of the volume of air inside the cooler. The less air, the better. Ordinarily, as the cooler is emptied over time, the volume of air inside the cooler increases in direct proportion to the volume of contents removed, and to the amount of melted ice water drained out through the drain spigot (if any). One way to lessen this effect is to reduce the volume of the free air circulation space over the internal contents and ice. To that end, as objects are removed from inside chamber 50, insert fitting 60 may be urged downward in its wiping contact engagement of the inside walls of chamber 50 to minimize the amount of air over the cooled material. By this means the circulating overhead air above the contents and ice is the reduced volume trapped between the contents and the underside of insert fitting 60. Inasmuch as insert fitting 60 has thermally insulative properties, the volume of air above insert fitting 60 and the underside of lid 24 is kept relatively segregated from the contents and the ice. The ice may then tend to be encouraged to endure longer before melting.

FIG. 3*h* show an enlargement, in cross-section of a generic edge of the panel, intended to represent any of margins 92, 94, 96 or 98. The spanning portion of the panel, be it of whichever section, is indicated generically as 140, and the marginal portion 142, be it of whichever section, which represents finger 100. The matrix of spanning portion 140 is shown in cross-section. It is indicated as 144. Matrix 144 is made of a polymeric foam. There is a transition 146 between spanning portion 140 and margin 142 at which spanning portion 140 meets margin 142. Transition 146 could be a square edge. However, in the example shown, transition 146 has an angled or chamfered face 148 that make the change in section less abrupt. Moreover, the chamfer tends to facilitate placement of insert fitting into mouth 52 of chamber 50, the chamfer tending to aid in self centering. The line shown in phantom as 130 corresponds to the through-thickness height of the inside face of the back of hinge 84. Similar sloped faces 152 are shown adjacent to hinges 82, 84 and 86 to permit a measure of flexibility beyond the normal unfolded horizontal orientation.

The thickness of spanning portion 140 is indicated as $t_{140}$. The thickness of finger 100 is indicated as $t_{100}$. In the example shown finger 100 is offset downward, or inwardly, so that it lies shy of the general horizontal plane of the outside of insert fitting 60, the offset being indicated as $z_{60}$. Similarly, the matrices 144 of the various sections extend downwardly proud of finger 100, that distance being indicated as $z_{144}$. While the outside offset is small, the inside offset $z_{144}$ is the majority of the through thickness of the panel.

Figure 4B:
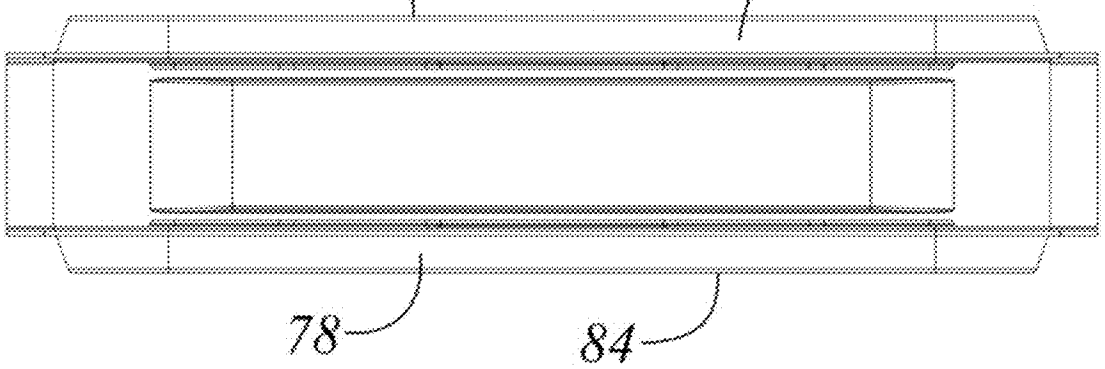
FIG. 4*b* is a top view of the folded insert fitting of FIG. 4*a;*
Figure 4A:
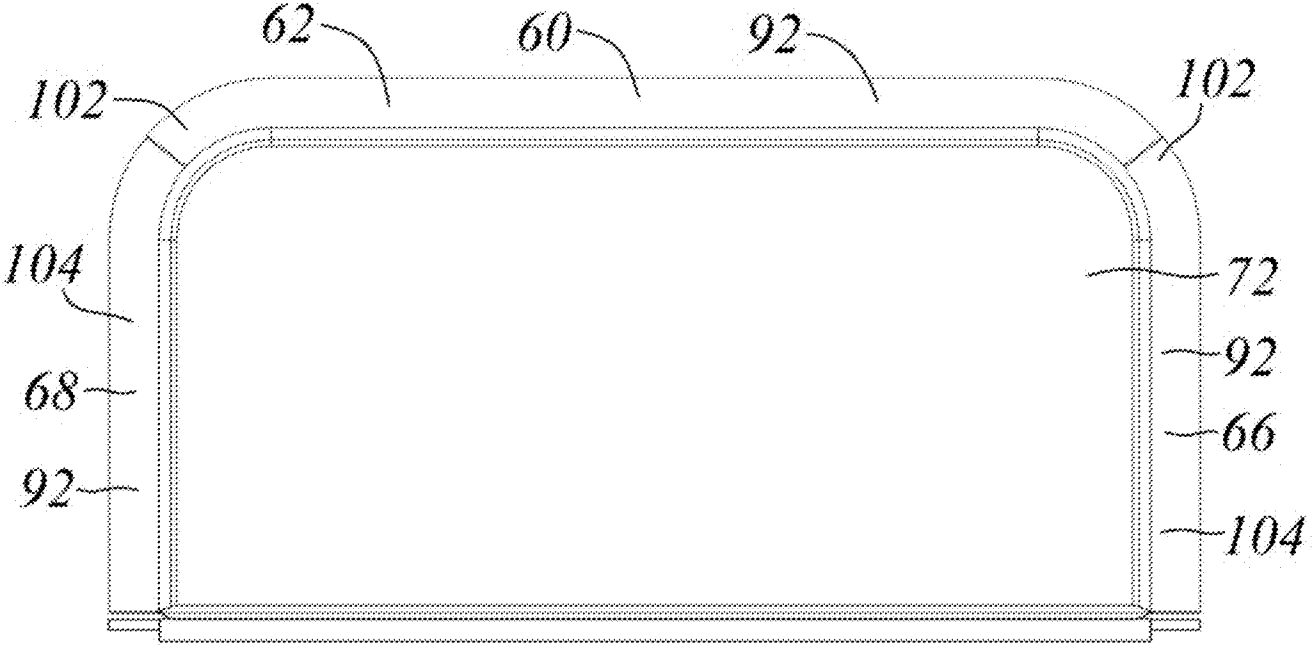
FIG. 4*a* is a plan view of the insert fitting of FIG. 3*a* in a folded condition.
Figure 4D:
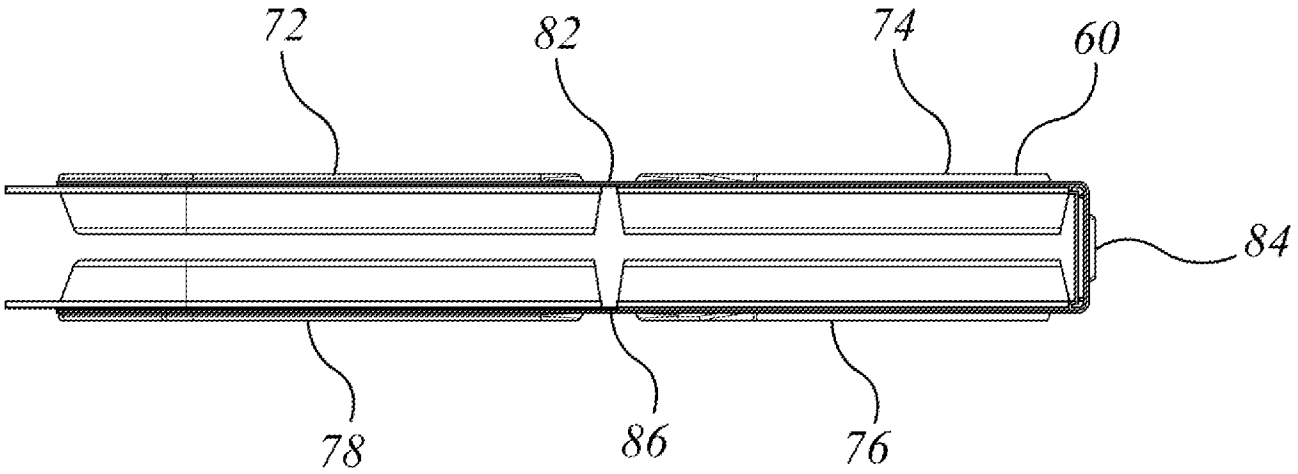
FIG. 4*d* is a side view of the insert fitting of FIG. 3*a* as half folded.
Figure 4E:
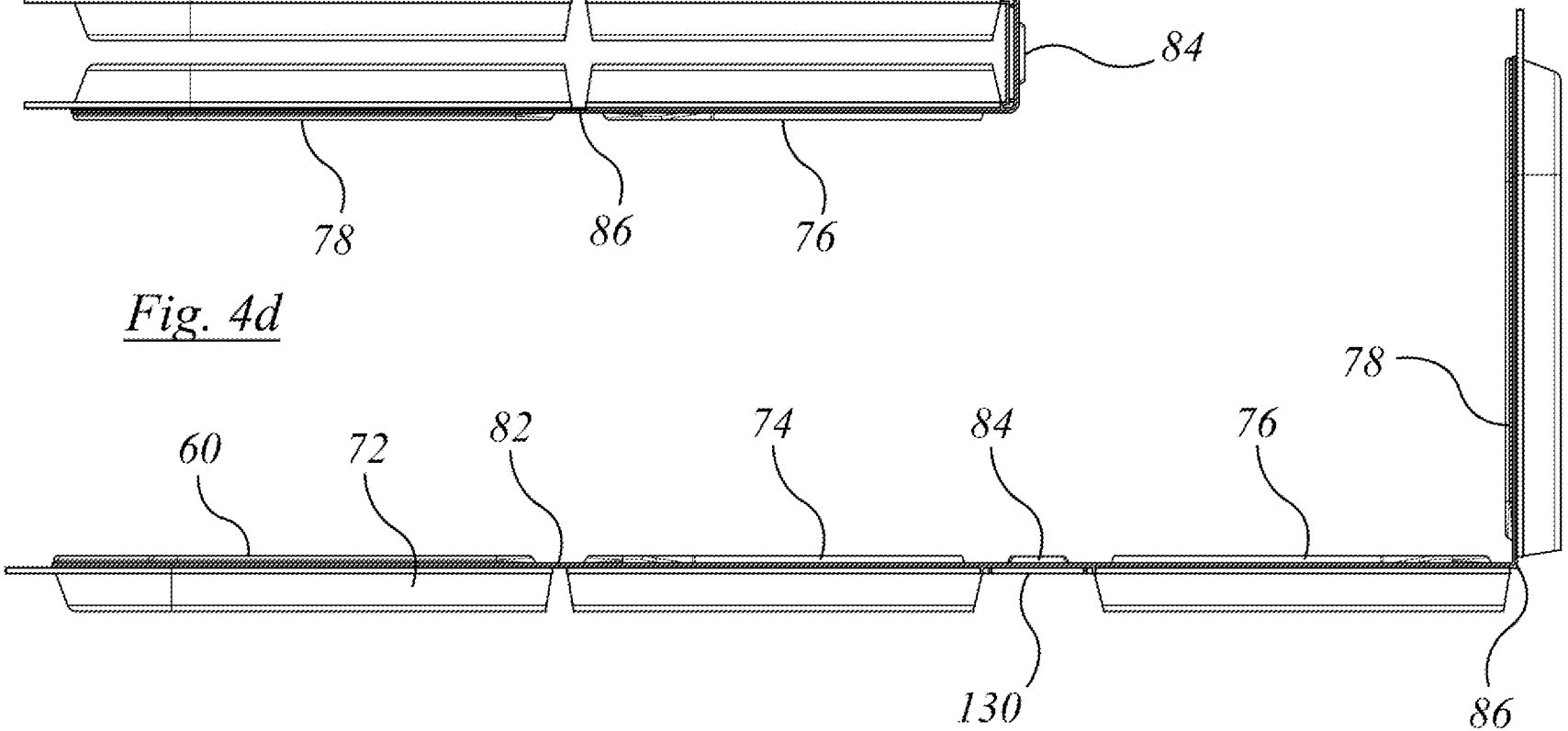
FIG. 4*e* is a side view of the insert fitting of FIG. 3*a* with one end lifted.

Since insert fitting 60 may be, and in the embodiment shown is, an articulated panel, FIGS. 4*a*, 4*b* and 4*c* show insert fitting 60 in its folded configuration. In FIG. 4*c*, sections 72, 74, 76 and 78 can be folded back-to-back against each other on the articulations defined by hinges 82, 84, 86, if desired, as for storage or shipping, or when not in use. FIGS. 4*a* and 4*e* show end section 72 lifted up, in a configuration such as might occur when a person is removing an item from one end of chamber 50. FIGS. 4*b* and 4*d* show half of insert fitting 60 folded back on the other half, as may be convenient. The folded over half can be used as a platform while re-arranging objects in the lower portion of chamber 50. When not in use, insert fitting 60 may be mounted to the outside of lid 24 in its flat configuration, as shown in FIG. 1*a*, and may function as a seat or cushion. It may fit in a recess or detent for that purpose. Alternatively, a securement such as a fabric fastener strip (one brand being "Velcro"™ may be used.

The method of operation of insert fitting 60 includes using it to minimize the volume of dead air in the container. That is, the method of use of fitting 60 to extend the life of the ice or cooling pack by reducing the volume of dead air over the cooler contents involves placing contents in the container to fill it to some extent, and with a thermal storage element (whether ice, an ice pack, or both); placing fitting 60 inside chamber 50 above the contents and thermal storage element; and subsequently moving at least a portion of fitting 60 to an at least partially open position to permit removal of at least a part of the contents. Fitting 60 is then replaced or repositioned above the remaining contents. The initial step of positioning may include the step of at least partially deflecting the peripheral margin to a first deflected position. The step of repositioning includes the step of advancing at least a portion of fitting 60 further into chamber 50 to occupy at least a portion of the volume vacated by the material removed from chamber 50. The step of advancing fitting 60 into the chamber includes deflecting the flexible peripheral margin to a second, more deflected condition. The method includes repeating the steps as items are removed successively from the container. Each advance of fitting 60 downward into a position of greater depth in chamber 50 reduces the air dead volume that would otherwise be over the contents and thermal storage member, or members. The method may include draining liquid water from chamber 50 from time to time. The method may include lifting one portion of fitting 60 by bending it on one of the hinges. The method also includes placing other objects or contents on top of the insert fitting such that it functions as a shelf or divider, or both.

In this process the margins of insert fitting 60 are engaged with the inside wall of chamber 50 of container 20, and, as successively and repeatedly re-positioned, are urged to ride along those walls. They may function as wipers as this occurs. With each successive re-positioning as the container is emptied, the deflection of the peripherally extending margin increases. In general, after each re-positioning lid 24 is closed, and remains closed until it is desired to remove more of the contents, or more of whatever remainder there may be until such time as the cooler is to be re-loaded with contents and thermal storage elements. The top side of insert fitting 60 may be used as a shelf on which to place other objects. When not in use, insert fitting 60 can be folded back on itself for storage. In use, by keeping the insert fitting in contact with the contents, the amount of dead air is reduced or minimized as the insert fitting is moved from position to position.

Another method of operation of fitting 60 is to use it as a seat cushion. That method includes the step of removing fitting 60 from chamber 50 and, in one version, the method include placing fitting 60 on top of lid 24 to act as a cushion.

Various container body and lid combinations have been shown, or described, or both. The features of the various embodiments may be mixed and matched as may be appropriate without the need for further description of all possible variations, combinations, and permutations of those features.

The principles of the present invention are not limited to these specific examples which are given by way of illustration. It is possible to make other embodiments that employ the principles of the invention and that fall within its spirit and scope of the invention. Since changes in and or additions to the above-described embodiments may be made without departing from the nature, spirit or scope of the invention, the invention is not to be limited to those details, but only by a purposive reading of the appended claims.

We claim:

1. A cooler insert fitting sized to mate with a cooler, said cooler insert fitting comprising:

a spanning matrix and a peripherally extensive margin, said peripherally extensive margin defining a dimensionally variable boundary follower;

said cooler insert is articulated to permit partial opening thereof;

said cooler insert is at least partially insulated;

said cooler insert fitting has a periphery that defines said margin;

said spanning matrix and said periphery are made from a single monolith of sheet stock;

said monolith is a blank that has a molded edge that is thinner than said spanning matrix, said molded edge defining said dimensionally variable boundary follower;

said peripherally extensive margin has a periphery; and said periphery of said peripherally extensive margin defines a deflectable wall following wiper;

said cooler insert fitting has a first articulation and a second articulation, said first articulation having a larger hinge than said second articulation; and said first and second articulations being operable in opposite directions.

2. A cooler insert fitting as claimed in claim 1 wherein said sheet stock is made of a polymeric foam.

3. The cooler insert fitting of claim 1 wherein said peripherally extensive margin is deformable in at least one of (a) in-plane compression; and (b) out-of-plane deflection.

4. A cooler insert fitting sized to mate with a cooler, said cooler insert fitting comprising:

a spanning matrix and a peripherally extensive margin, said peripherally extensive margin defining a dimensionally variable boundary follower;

said cooler insert is articulated to permit partial opening thereof;

said cooler insert is at least partially insulated;

said cooler insert fitting has a periphery that defines said margin;

said spanning matrix and said periphery are made from a single monolith of sheet stock;

said monolith is a blank that has a molded edge that is thinner than said spanning matrix, said molded edge defining said dimensionally variable boundary follower;

said peripherally extensive margin has a periphery;

said periphery of said peripherally extensive margin defines a deflectable wall following wiper; and said cooler insert fitting is softer and more flexible than a rigid cooler liner, and said cooler insert fitting defining a seat cushion mountable to a cooler lid of the cooler when said cooler insert fitting is not in use inside the cooler.

5. The cooler insert fitting of claim 4 wherein said peripherally extensive margin is more easily compressed in in-plane deflection than is said spanning matrix.

6. The cooler insert fitting of claim 4 wherein said spanning matrix has a higher flexural modulus than does said peripherally extensive margin.

7. A cooler insert fitting sized to mate with a cooler, said cooler insert fitting comprising:

a spanning matrix and a peripherally extensive margin, said peripherally extensive margin defining a dimensionally variable boundary follower;

said cooler insert is articulated to permit partial opening thereof;

said cooler insert is at least partially insulated;

said cooler insert fitting has a periphery that defines said margin;

said spanning matrix and said periphery are made from a single monolith of sheet stock;

said monolith is a blank that has a molded edge that is thinner than said spanning matrix, said molded edge defining said dimensionally variable boundary follower;

said peripherally extensive margin has a periphery; and said periphery of said peripherally extensive margin defines a deflectable wall following wiper;

said periphery forms an edge of said spanning matrix of said cooler insert fitting, and said periphery is thinner in cross-section than is said spanning matrix; said cooler insert fitting has an upper surface defining a shelf upon which to place objects, and a lower surface that, in use, is oriented toward objects inside the cooler; and said edge is offset shy of the upper surface by a first distance; said offset edge being offset from said lower surface by a second distance, said second distance being larger than said first distance.

8. The cooler insert fitting of claim 7 wherein said periphery has a smaller specific flexural modulus than said matrix.

9. The cooler insert fitting of claim 7 wherein said spanning matrix and said periphery are made from a single monolith of sheet stock have a chamfered transition from said periphery to said lower surface, said chamfer being deeper than said first distance.

10. The cooler insert fitting of claim 9 wherein said monolith is a blank of said sheet stock that has a molded edge that is thinner than said spanning matrix and said blank is made of a polymeric foam.

11. A partition for a cooler, the partition comprising:

a spanning portion and a wall follower portion;

said partition being made of a monolith of polymeric material;

said wall follower portion being thinner than said matrix portion;

at least part of said partition being insulated;

said spanning portion being thicker than said follower portion;

said spanning portion having a higher flexural modulus than said wall follower portion;

said wall follower of said partition defining a wiper that, in operation, engages an inner wall of the cooler;

said wall follower portion being deflectable;

said wall follower portion being more easily deflected out-of-plane in bending than said spanning portion;

said partition having a set of panels, the panels being joined at articulations defined by hinges;

said articulations permitting partial opening of said partition;

said set of panels including a first panel, a second panel and a third panel;

said first panel and said second panel being connected by a first hinge;

said second panel and said third panel being connected by a second hinge; and said second hinge having a larger reach than said first hinge.

12. The partition of claim 11 wherein said wall follower portion is more easily compressed in in-plane deflection than is said spanning portion.

13. The partition of claim 11 wherein;

said partition has an outside face and an inside face;

said outside face defines a shelf upon which to place objects;

said follower portion is offset from said spanning portion such that said follower portion is closer to said outside face than to said inside face;

said set of panels includes a fourth panel and a third hinge;

said fourth panel being connected to said third panel by a third hinge;

said first, second and third hinges being located at said outside face;

said first hinge and said third hinge being operable to fold opposite to said second hinge such that said first, second, third and fourth panels fold back-to-back;

said wiper is offset from said outside face by a first distance; said wiper is offset from said inside face by a second distance; said second distance is greater than said first distance; and there is a chamfer from said inside face of spanning portion of said partition to said wiper, whereby said chamfer tends to self-center said partition relative to the cooler on installation.

14. The partition of claim 11 wherein said partition has an outside face and an inside face; and said follower portion is offset from said spanning portion such that said follower portion is closer to said outside face than said inside face.

15. The partition of claim 11 wherein said first hinge is operable to fold said second panel relative to said first panel; said second hinge is operable to fold said third panel relative to said second panel, said second hinge being operable to fold in the opposite direction from said first hinge.

16. The partition of claim 15 wherein said partition has an outside face and an inside face; at least part of said spanning portion is insulated; and said outside face defines a shelf upon which to place objects.

17. The partition of claim 11 wherein said partition has an outside face and an inside face; said wiper is offset from said outside face by a first distance; said wiper is offset from said inside face by a second distance; said second distance is greater than said first distance; and there is a chamfer from said spanning portion to said wiper, whereby said chamfer tends to self-center said partition relative to the cooler on installation.

18. The partition of claim 11 wherein said spanning portion has a higher flexural modulus than does said wall follower portion.

19. The partition of claim 11 wherein said partition has an outside and an inside; said follower portion is offset from said spanning portion such that said follower portion is closer to said outside than said inside.

* * * * *